US005577591A

United States Patent [19]

Abe

[11] Patent Number: 5,577,591

[45] Date of Patent: Nov. 26, 1996

[54] COIN SELECTING APPARATUS

[75] Inventor: Hiroshi Abe, Tokyo, Japan

[73] Assignee: Asahi Seiko Kabushiki Kaisha, Tokyo, Japan

[21] Appl. No.: 335,386

[22] Filed: Nov. 3, 1994

[30] Foreign Application Priority Data

Nov. 4, 1993 [JP] Japan ..... 5-308496

[51] Int. Cl.[6] ..... G07F 1/02

[52] U.S. Cl. ..... 194/343; 194/344

[58] Field of Search ..... 194/335, 339, 194/343, 344, 347, 348, 331

[56] References Cited

U.S. PATENT DOCUMENTS

| | | | |
|---|---|---|---|
| 896,965 | 8/1908 | Wissing | 194/335 |
| 2,734,680 | 2/1956 | Jones | 194/344 X |
| 4,376,480 | 3/1983 | Abe | 194/323 |
| 4,469,213 | 9/1984 | Nicholson et al. | 194/320 |
| 4,570,779 | 2/1986 | Abe | 194/318 |

FOREIGN PATENT DOCUMENTS

| | | | |
|---|---|---|---|
| 461805 | 12/1991 | European Pat. Off. | 194/344 |
| 418423 | 10/1934 | United Kingdom | 194/335 |

*Primary Examiner*—F. J. Bartuska
*Attorney, Agent, or Firm*—Sughrue, Mion, Zinn, Macpeak & Seas

[57] ABSTRACT

A coin selecting apparatus includes a damper ball arranged beside a coin passage to contact inserted coins and a ball guide for smoothly guiding the damper ball, in order to adjust inserting speed of the inserted coins in association with movements of the damper ball. The damper ball travels from a first position to a second position of the ball guide upon impact of the inserted coin to absorb kinetic energy of the coin, thereby regulating the speed of the coin. The damper ball then returns to the first position as rolling and contacting with walls of the guide, thereby changing the location of the impact point on the damper ball so as to prevent the ball from being worn or impaired. Where the first position is placed at a lower position than the second position, the damper ball can return by itself in aid of force of gravity. A pushing member, if provided, may enhance applicability of the coin selecting apparatus since the ball guide could be designed less restrictedly.

7 Claims, 5 Drawing Sheets

COIN SELECTING APPARATUS

BACKGROUND OF THE INVENTION

1. Field of the Invention

This invention relates to a coin selecting apparatus incorporated in a coin operated machine such as a vending machine, a game machine, or whatever, or namely, an apparatus for selecting such as the size and material of an inserted coin by mechanical or electromagnetic means and, more particularly, to a control mechanism for controlling inserting speed of the coin inserted in such a coin selecting apparatus.

2. Description of Related Art

Coin selecting apparatuses mechanically or electromagnetically selecting inserted coins, as described in U.S. Pat. Nos. 4,376,480 and 4,570,779, have been known as conventional ones. Those apparatuses detect coins in a following manner. That is, where a coin passage extends from the top to the bottom of an apparatus, a coin inserted from a slot provided at the top of the passage travels along the coin passage and reaches an outlet located at the bottom end of the passage. While the inserted coin is traveling along the passage, mechanical or electromagnetic means such as composed of a cradle, a magnet, an electromagnet, or the like which is arranged on a side of the coin passage detects the size, material, and the like of the inserted coin.

Such a coin selecting apparatus is capable of properly selecting as to whether the inserted coin is acceptable or unacceptable. However, assembly circumstances of which the coin selecting apparatus is built-in may vary depending on structures or designs of the coin operative machines, and the coin selecting apparatus can be incorporated in a manner that nobody can currently anticipate. This would bring irregular or uneven speeds of inserted coins. For example, where an electronic coin selecting apparatus is incorporated in a vending machine, a longer distance between a coin slot of the vending machine and a slot of the coin selecting apparatus accelerates the inserted coin, thereby making the coin pass through the selecting apparatus at a faster speed than in the case of a shorter distance. As a result, the electronic sensing device may improperly work, so that a coin to be accepted could be rejected or that an unacceptable coin could be accepted. The same thing may occur to mechanical and other coin selecting apparatuses.

As for adjusting inserting speed of an inserted coin, there have been proposed various fall adjusting means. For example, U.S. Pat. No. 4,469,213 discloses such a mechanism. This mechanism includes a pendulum damper, as an aid for speed control, pivotally movable around a shaft. However, this pendulum damper raises a problem. Inserted coins always impact on the same point of the pendulum damper. Where many coins are successively inserted for a long period of time, the damper would be worn or become dirty or impaired at the impact point. When the contact portion between the pendulum damper and the shaft is worn or impaired, the pendulum damper cannot smoothly swing. Those problems prevent the pendulum damper from working effectively, thereby impairing selection ability of the coin selecting apparatus.

SUMMARY OF THE INVENTION

It is an object of the invention to provide a mechanism for adjusting inserting speed of inserted coins that is free from being worn or impaired to prevent the adjusting mechanism from losing its adjusting ability and to enhance its applicability to various designs of machines in which the adjusting mechanism is incorporated.

The foregoing object is accomplished with a coin selecting apparatus including a coin slot for inserting a coin, a coin passage for passing the coin inserted, coin selecting means for selecting the inserted coin, and speed adjusting means for adjusting inserting speed of the inserted coin. The speed adjusting means includes a damper ball to contact with the inserted coin and a ball guide for guiding said damper ball. The ball guide extends between a first position at which said damper ball contacts with the inserted coin and a second position that said damper ball reaches when pushed by the inserted coin. The first position is placed lower than the second position so that said damper ball reached the second position falls by its weight to the first position. The term of "falling by its weight" is meaning that the damper ball at the second position will return to the first position along the ball guide by force of gravity. When the inserted coin impacts the damper ball provided at the coin passage, kinetic energy of the inserted coin is absorbed by movement of the damper ball from the first position to the second position, resulting in that the inserting speed of the inserted coin is adjusted by its deceleration. Consequently, the inserted coin passes through the coin selecting means after decelerated to a constant inserting speed by means of the damper ball notwithstanding its initial inserting speed, so that the coin selecting means can stably and accurately perform selection of the coin. The damper ball is then automatically returned to the first position by falling by its weight to wait next coins. During this return movement, the damper ball contacts walls of the ball guide to roll itself and its impact position is changed, whereby the damper ball is protected from being worn and impaired.

According to an embodiment of the invention, the coin passage is constituted of two pieces of plates, at which the ball guide or guides are formed. The ball guide can be connected to at least one opening for cleaning which is made to be certain size as to permit sufficient cleaning as well as to prevent the damper ball from being detached. A pair of the speed adjusting means can be arranged at the coin passage so as to oppose widthwise with each other.

In another aspect of the invention, the coin selecting apparatus may have a pushing member for pushing back the damper ball from the second position to the first position in lieu of force of gravity. The pushing member allows the design of the ball guide to be flexible such that the first position is higher than the second position or that the guide extends horizontally. Similarly to the above, the damper ball contacts walls of the ball guide to roll itself and its impact position is changed, whereby the damper ball is protected from being worn and impaired. The pushing member may include a spring or an elastic body.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
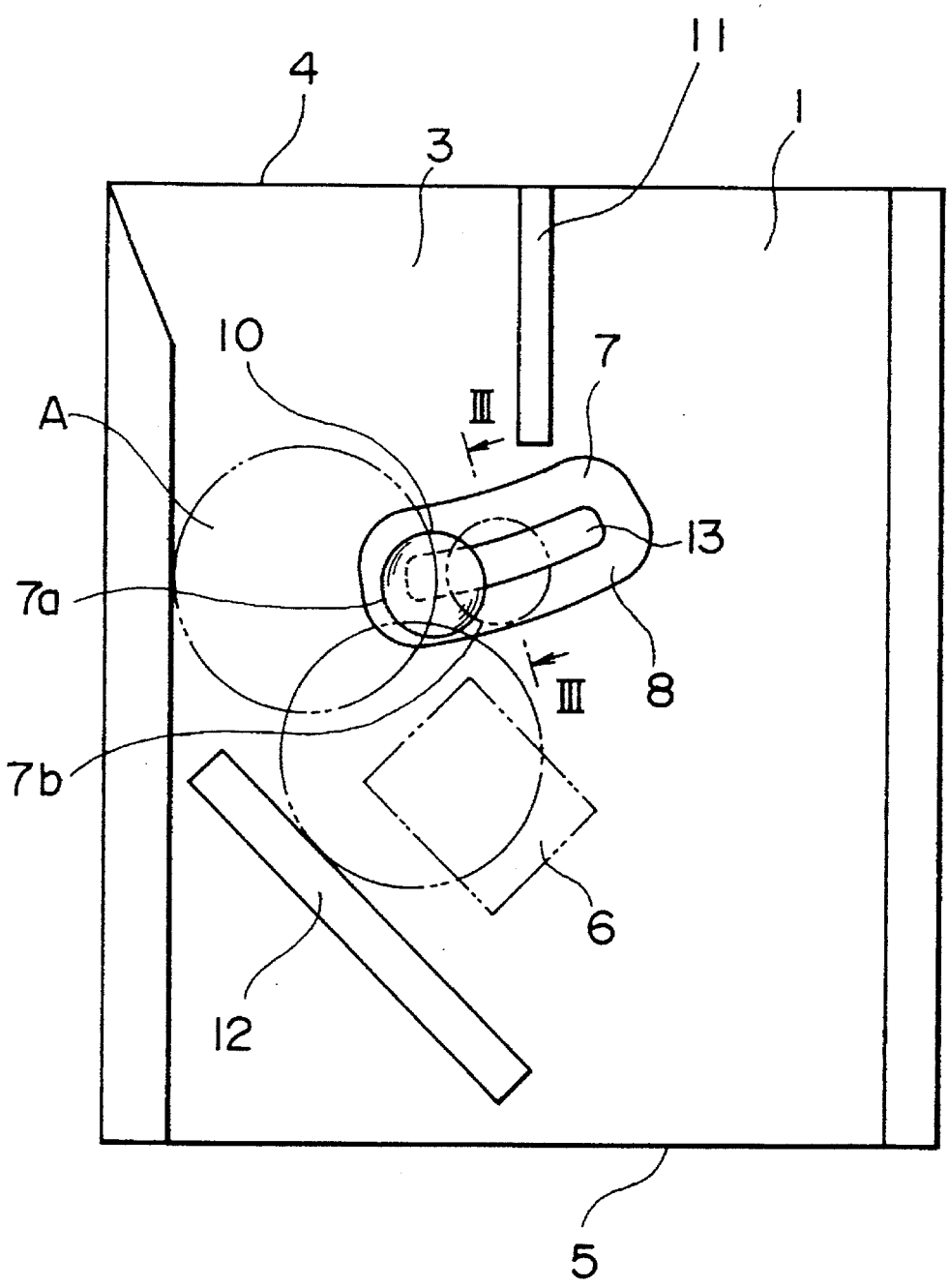
FIG. 1 is a schematic side view showing a coin selecting apparatus according to a first embodiment of the invention.
Figure 2:
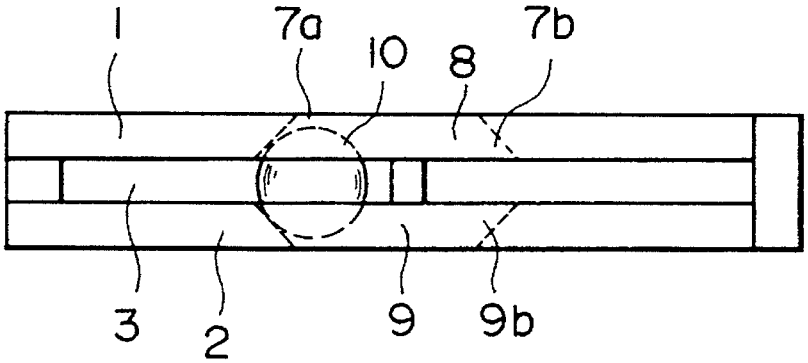
FIG. 2 is a plan view showing the coin selecting apparatus in FIG. 1.
Figure 3:
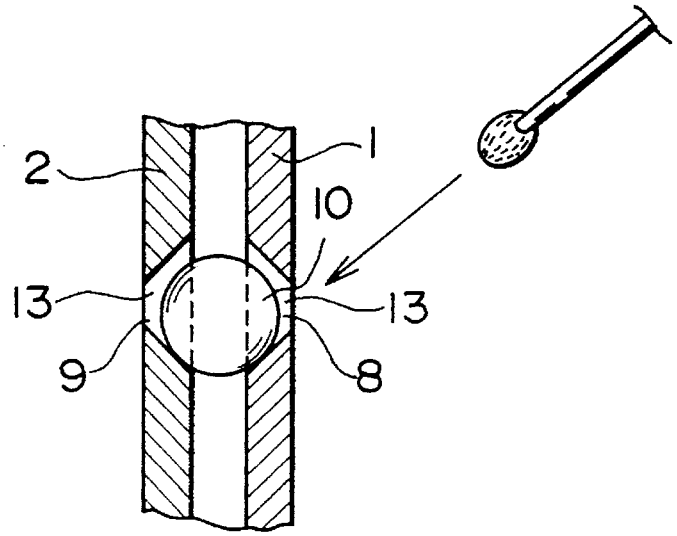
FIG. 3 is a cross-sectional view showing a part of the coin selecting apparatus taken along III—III line in FIG. 1.

Referring to the drawings in detail, in particular, to FIGS. 1 to 3, a coin selecting apparatus according to a preferred embodiment of the invention is shown.

As showing in FIGS. 1, 2, a pair of side plates 1, 2 is provided with a space between both plates extending vertically in parallel to allow coins to enter therebetween. The side plate 1 and the side plate 2 are made separately, but, at an option, may be made in a uniform body. A partition wall 11 and a ramp 12 for guiding inserted coins A are provided between the side plates 1, 2. A coin passage 3 is formed from those plates 1, 2, the partition wall 11, and the ramp 12 so as to extend from a coin slot 4 to a lower end outlet 5.

An electronic coin detector 6, as coin selecting means, indicated by a chain line in FIG. 1, is mounted beside the coin passage 3 on a rear side of the side plate 1, or on a side of the side plate 1 in opposition to the side of the coin passage 3. As the electronic coin detector 6, though there are various types, a type disclosed in Japanese Unexamined Pat. (KOKAI) Hei No. 2-133,895 filed by this assignee is desirable. That is, the electronic coin detector 6 is constituted of a combination of a sensor coil and an oscillating circuit and detects changes of inductance of the sensor coil when the inserted coin crosses the magnetic flex linkage at the coin passage 3. The detector 6 then compares the detected result with data of acceptable coins previously memorized in a memory to detect as to whether the inserted coin is within a certain permissible range. The coin detector could be made, in addition to such an electronic coin detector 6, in a mechanical type in which a cradle or the like detects size and weight of the inserted coin, a magnetic type in which a permanent magnet or the like distinguishes ferromagnetic material coins from paramagnetic material coins, a low frequency type in which low frequency, such as acoustic wave, detects the resonance frequency of inserted coins, and further, an optical type in which light is used.

Referring to FIG. 1, constitution of a ball guide 7 and a damper ball 10, as speed adjusting means, is described as follows. The ball guide 7 is constituted of a guide groove 8 opened at the side plate 1 and a guide groove 9 opened at the side plate 2 in opposition to the guide groove 8. Although in this embodiment the guide grooves 8, 9 are opened at both side plates 1, 2, the ball guide 7 could be constituted of a single guide groove opened at either one of side plates. The ball guide 7 extends so as to circumferentially curve in order to allow the damper ball 10 to smoothly perform reciprocal movements. The cross section of the ball guide 7 is also made in sufficient size as shown in FIG. 3 and allows smooth traveling of the ball 10.

The ball guide 7 includes a first position 7*a* and a second position 7*b* as indicated by respective numerals in FIG. 1. The first position 7*a* coincides with the position at which the damper ball 10 depicted with a solid line exists; the second position 7*b* coincides with the position at which the damper ball 10 depicted with a chain line exists. The first position is located at a lower position than the second position to let the damper ball traveling up to the second position fall to the first position by its weight. An angle θ between a line connecting the first position 7*a* with the second position 7*b* and a horizontal line passing the first position 7*a* and the whole length of the ball guide 7 are determined based on, such as, size and weight of coins to be inserted. The coin selecting apparatus can correspond to any kind of coins by properly selecting the angle and whole length.

Where an opening 13 for cleaning, connecting to the ball guide 7, is opened at either or both of the side plates 1, 2, the opening 13 further effectuates to prevent the damper ball 10 from becoming dirty. The opening 13 for cleaning promotes natural exhaust of dusts attached on the damper ball 10 and receives cleaning tools such as swabs to allow the inside of the ball guide 7 to be cleaned. The opening 13 for cleaning is formed that its size never permits the damper ball 10 to come out of the ball guide 7.

The damper ball 10 is made of stainless ball, and its surface is given treatments to be so smooth that the surface is hardly to be worn and become dirty. The damper ball 10 is forced by the inserted coin to move from the first position 7*a* to the second position 7*b*, and then, falls by its weight back to the first position 7*a* as rolling and contacting with the guide grooves 8, 9. Accordingly, each return of the damper ball 10 to the first position 7*a* changes the location of the point to be impacted by the inserted coin, thereby preventing the damper ball from being worn and dirty or impaired. Since the damper ball 10 is designed to fall by its weight from the first position 7*a* to the second position 7*b*, no special member is required for this operation, and the apparatus is effectuated with a simple structure and without extra expenses.

The coin that had passed the coin selecting means goes to a receiving chute if acceptable and to a returning chute if unacceptable.

Figure 4:
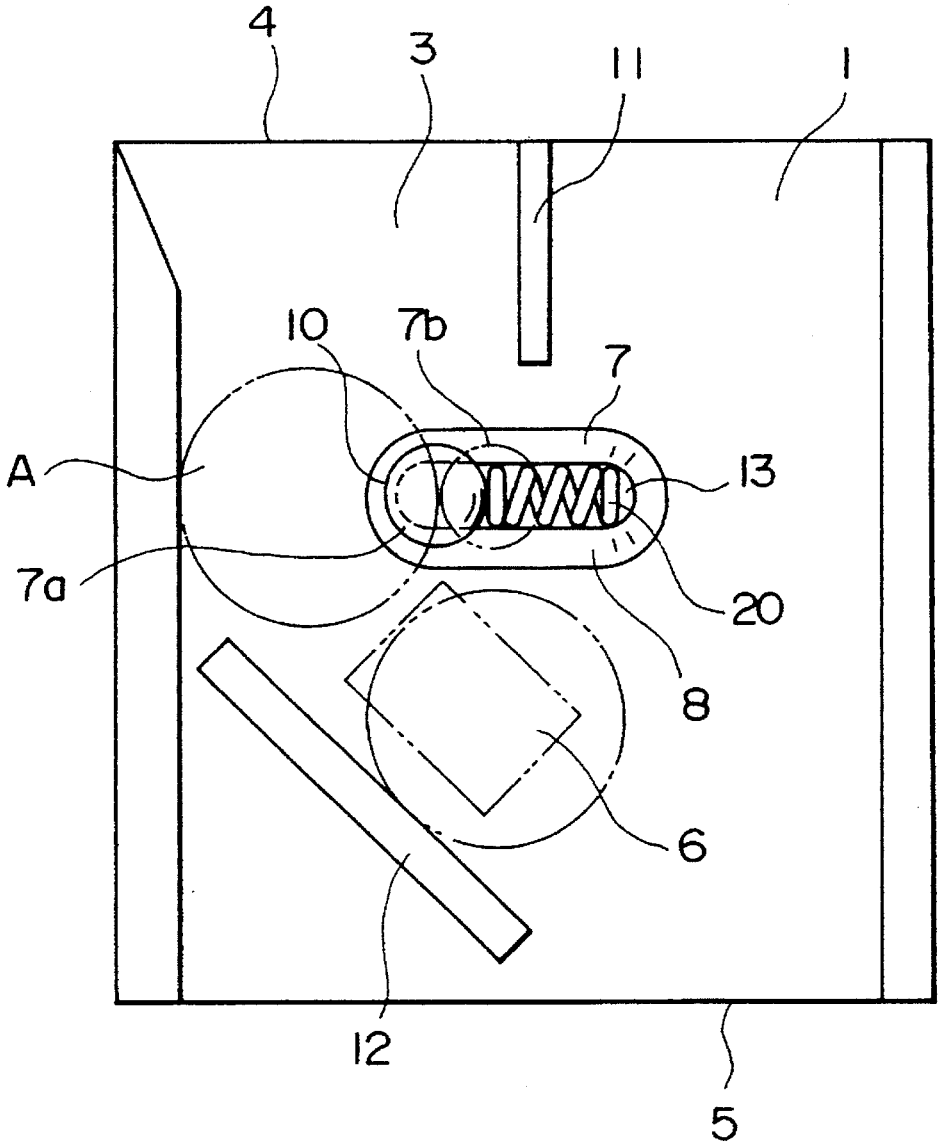
FIG. 4 is a schematic side view showing a coin selecting apparatus according to a second embodiment of the invention.

Referring to FIG. 4, there describes another coin selecting apparatus according to a second embodiment. The same numerals are used for the common members as those of the first embodiment. The numeral 20 indicates a coil spring as a pushing member. The spring constant of the coil spring 20 is selected to be the optimum based on size and weight of coins to be inserted. The damper ball 10 is not fixed to the coil spring 20 so as to rotate freely.

Upon an impact from the inserted coin A, the damper ball 10, stayed at the first position 7*a*, is forced to move to the second position 7*b* as opposing to the elastic force of the coil spring 20. The returning force of the coil spring 20 forcibly then pushes the damper ball 10 from the second position 7*b* back to the first position 7*a*. At that time, since the damper ball 10 travels as rolling and contracting with the guide grooves 8, 9, each return of the damper ball 10 changes the location of the point to be impacted by the inserted coins, thereby preventing the damper ball 10 from being worn and becoming dirty.

Figure 5:
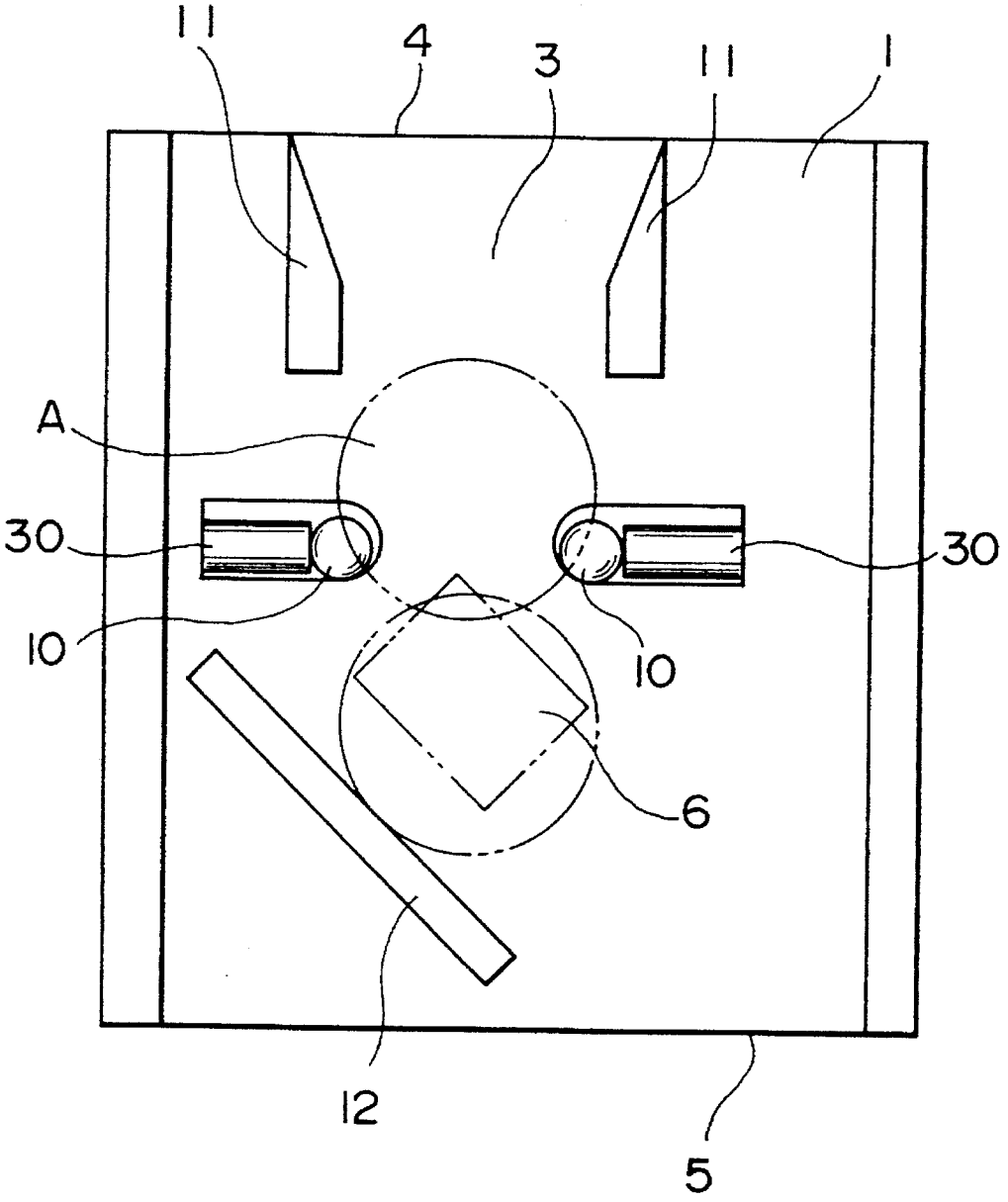
FIG. 5 is a schematic side view showing a coin selecting apparatus according to a third embodiment of the invention.
Figure 6:
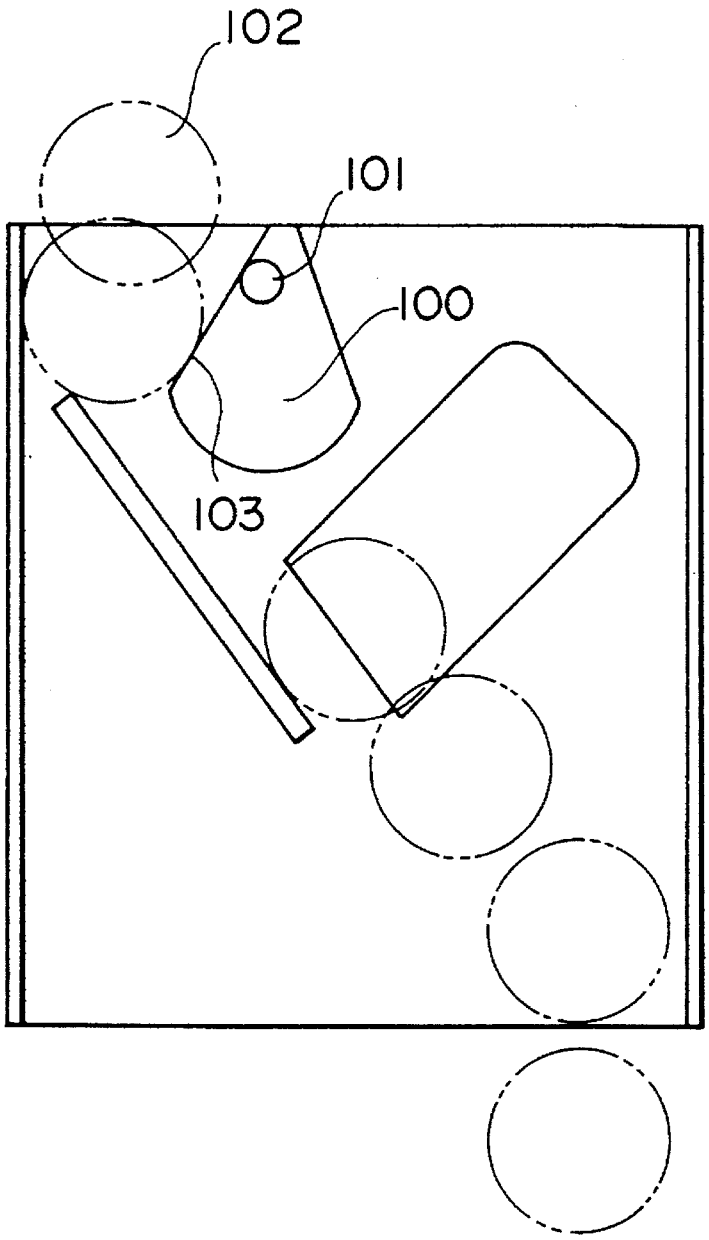
FIG. 6 PRIOR ART
FIG. 6 is a side view showing a prior art speed adjusting means.

Referring to FIG. 5, there describes yet another coin selecting apparatus according to a third embodiment of the invention. The same numerals are used for the common members as those of the first embodiment. The numeral 30 indicates an elastic body as a pushing member. In this embodiment, urethane rubber is employed for the elastic body 30. Hardness of the urethane rubber is determined based on the size and weight of coins to be inserted. The damper ball 10 is not fixed to the elastic body 30 so as to rotate freely. This embodiment also has the same effects as the second embodiment.

As described above, the coin selecting apparatus is equipped with the inserting speed adjusting means hardly worn and becoming dirty, so that even if used for a long period of time the inserting speed adjusting means would not lose damper effects against the inserted coins. The inserting speed adjusting means thus would maintain its performance ability, thereby contributing wide applicability of the coin selecting apparatus to various designs of coin operated machines.

It is to be noted that the damper ball is not restricted in a spherical shape and can be formed in other shapes as long as suitable for achieving the object of the invention. Therefore, the damper ball can be, for example, an elliptic body, a polygonal body, or whatever. Although the damper ball is generally made of, for example, a metal ball such as stainless, it can be constituted of nonmetal materials such as synthetic resins or ceramics and further be constituted of any material such as mixtures of metals and synthetic resins. The surface of the damper ball is preferably finished so smooth to prevent it from being worn. The number of the damper ball is unlimited and can be one or above. The ball guide can be any other shape capable of properly guiding the damper ball. For example, it is desirable for the ball guide to be formed by grooves opened at side plates opposing so as to sandwich the coin passage, as described above, because it is easy to form. The ball guide can be formed in a pipe, as separated body from the side plate, which is designed so as to be detachably attached to the coin selecting apparatus body. Such design is convenient for replacing the apparatus with another in comply with size or the like of the coins to be inserted.

Moreover, the pushing member can be made of but not restricted to a spring or an elastic body. Any material can be used as long as the damper ball can be returned. Plural different members may constitute the pushing member.

In this specification, the "spring" is meaning a mechanical element essentially utilizing elastic nature or energy accumulation due to distortion of substance; the "elastic body" is meaning a nonmetal spring, such as rubber or synthetic resin made, capable of accumulating energy occurring by changes of its volume; the "coin" includes coins and further nominal coins, such as, tokens, medals, and whatever.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A coin selecting apparatus comprising:

a coin slot for inserting a coin;

a coin passage for passing the coin inserted from said coin slot;

coin selecting means arranged along said coin passage for selecting the inserted coin; and speed regulating means, arranged along said coin passage on an upstream side of said coin selecting means, for regulating the inserting speed of the inserted coin, the speed regulating means comprising:

a damper ball to contact with the periphery of the inserted coin; and a ball guide for guiding said damper ball between a first position at which said damper ball contacts with the periphery of the inserted coin and a second position that said damper ball reaches when pushed by the inserted coin, the first position being placed lower than the second position so that said damper ball that had reached the second position falls by its weight to the first position.

2. A coin selecting apparatus according to claim 1, wherein said coin passage is composed of two pieces of plates, each of which is formed with said ball guide.

3. A coin selecting apparatus according to claim 2, wherein at least one of said two pieces of plates is formed with an opening, which is formed in size that said damper ball cannot be pulled out, for cleaning and connecting said ball guide.

4. A coin selecting apparatus according to claim 1, wherein said speed adjusting means is arranged on the respective sides of said coin passage so as be located in opposition to each other.

5. A coin selecting apparatus comprising:

a coin slot for inserting a coin;

a coin passage for passing the coin inserted from said coin slot;

coin selecting means arranged along said coin passage for selecting the inserted coin; and speed regulating means, arranged along said coin passage on an upstream side of said coin selecting means, for regulating the inserting speed of the inserted coin, the speed regulating means comprising:

a damper ball to contact with the periphery of the inserted coin;

a ball guide for guiding said damper ball between a first position at which said damper ball contacts with the periphery of the inserted coin and a second position that said damper ball reaches when pushed by the inserted coin; and a pushing member for pushing said damper ball that had reached said second position, back to said first position.

6. A coin selecting apparatus according to claim 5, wherein said pushing member includes a spring.

7. A coin selecting apparatus according to claim 5, wherein said pushing member includes an elastic member.

* * * * *